United States Patent [19]

Riggs

[11] 4,355,961

[45] Oct. 26, 1982

[54] CONTROLLING MEANS FOR A FUEL VALVE

[75] Inventor: Thomas C. Riggs, Okmulgee, Okla.

[73] Assignee: Ingersoll-Rand Company, Woodcliff Lake, N.J.

[21] Appl. No.: 892,699

[22] Filed: Apr. 3, 1978

[51] Int. Cl.[3] ..... F04B 7/04

[52] U.S. Cl. ..... 417/494; 137/624.15; 417/499; 251/57

[58] Field of Search ..... 137/624.11, 624.18, 137/624.2, 624.13, 624.15; 417/494, 499; 285/302; 251/57

[56] References Cited

U.S. PATENT DOCUMENTS

| | | | |
|---|---|---|---|
| 2,378,165 | 6/1945 | Waeber | 417/494 X |
| 2,533,097 | 12/1950 | Dale | 285/302 |
| 3,417,702 | 12/1968 | Behm | 417/494 |

*Primary Examiner*—Alan Cohan

*Attorney, Agent, or Firm*—B. J. Murphy

[57] ABSTRACT

The invention comprises a control valve which is interposed between a hydraulically-operated fuel valve (for an engine) and a hydraulic fluid supply for regulating the operation (i.e, the opening and closing) of the fuel valve. The control valve has a housing-enclosed, sliding plunger which is spring-loaded to urge the plunger in a first direction in the housing, and which is translated in a second, opposite direction against the spring bias, by a contacting, rotating cam. Hydraulic fluid inlet and outlet ports are formed in the housing and are cyclically communicating and closed off from each other, for given periods of time, due to the translations of the plunger. The housing has an adjusting element operative for altering the translation of the plunger relative to the housing, to alter the given time periods and, as a consequence, the fuel valve is selectively and adjustably regulated thereby.

8 Claims, 2 Drawing Figures

CONTROLLING MEANS FOR A FUEL VALVE

Figure 1:
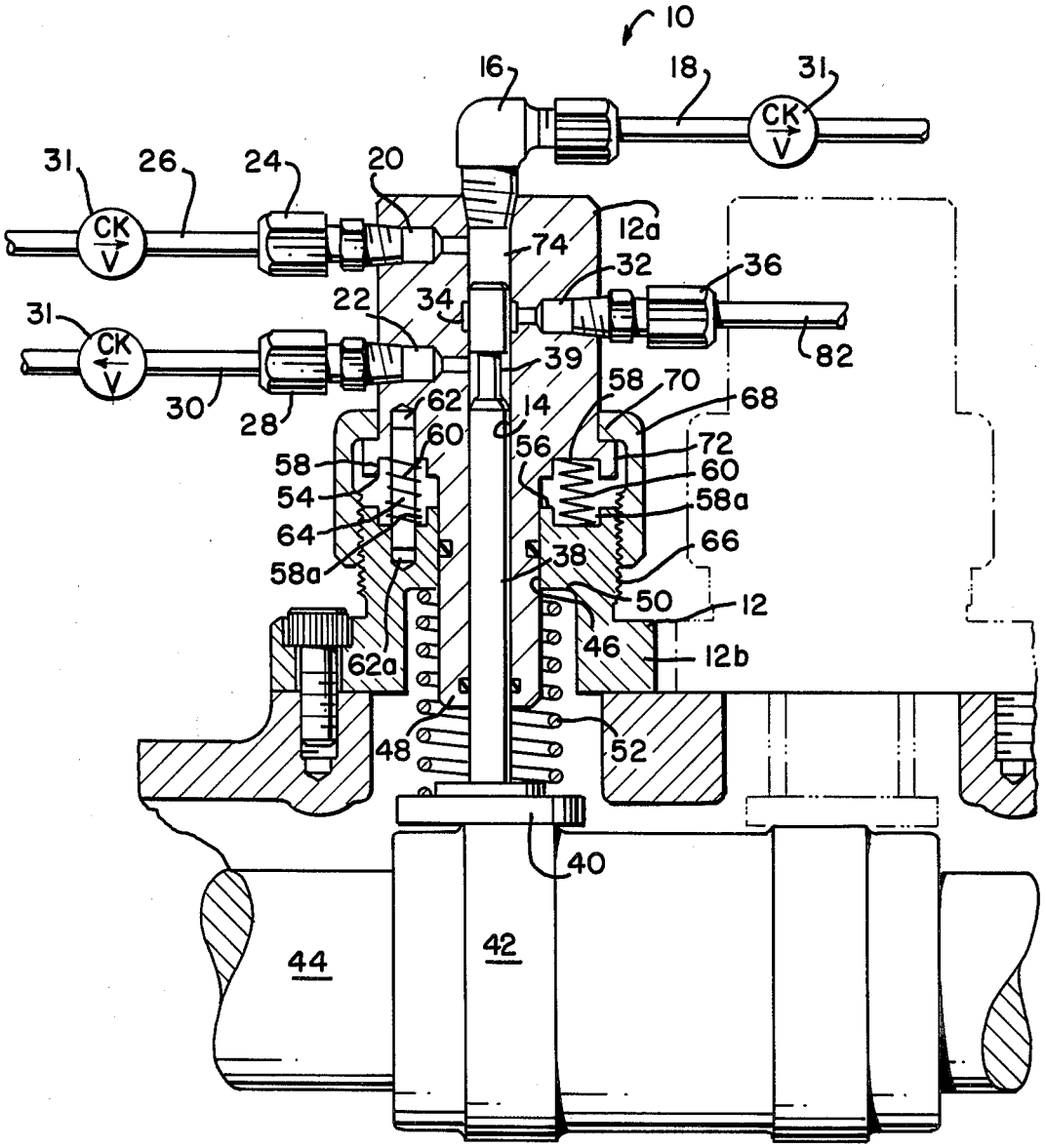

This invention pertains to controlling means, and in particular concerns means for controlling a hydraulically-operated fuel valve, which controlling means comprises selectively operative adjustment means for regulating the operation of the fuel valve.

Controlling means of the type disclosed herein are quite well known. Generally they comprise a cam-operated device which addresses a series of timed and metered charges of hydraulic fluid to the fuel valve (in an engine cylinder) to cause the latter to open and admit fuel therethrough. The elapsed time or duration of the opening of the fuel valve depends upon the timing or duration of the hydraulic-fluid charge. Now, to control the hydraulic-fluid charge, i.e., to vary it, so as to adjustably regulate the fuel valve, it is known to employ an adjustable spillport arrangement. Exemplary of this is the "Hydraulic Valve Operating Mechanism Operable to Vary Valve Lift and Valve Timing" disclosed in U.S. Pat. No. 2,602,434, issued to James C. Barnaby, on July 8, 1952. In this Mechanism, there is a means for varying the duration and timing of the valve lift by rotational adjustment of sliding, hydraulic-fluid-expelling plungers which translate in cylindrical housings of the controlling means. The plungers have inclined end faces, and a manual adjustment ring turns the end faces relative to spillports. The plungers in this mechanism always exhibit a same, repetitive, and unalterable movement relative to their respective cylindrical housings; it is only the inclined end faces which have a variable disposition relative to the spillports.

Another prior art arrangement is disclosed in U.S. Pat. No. 1,608,322, issued to K. O. Keller, on Nov. 23, 1926, for an "Internal Combustion Engine". In this the patentee set forth a cam-operated, fuel valve controlling device, which employs a single conduit for conducting a valve-operating charge of hydraulic fluid therethrough from the device (to the fuel valve), and also for returning the spent fluid to the device—for discharge to the fluid reservoir. This patentee's arrangement has no means for expelling the fluid charge from the device; it must operate with a pressured-fluid system. Too, it incorporates no adjustment means for varying the fluid charge duration.

A more recent disclosure of a "Fuel Injection Control System" is detailed in U.S. Pat. No. 3,872,844, issued to Alfred C. Gates, on Mar. 25, 1975. This system also must operate with a pressured-fluid or fluid-pumped system. Too, rather than having a plunger which expels a charge of fluid, the metered charge of pressured fluid translates a plunger—which, in turn, directly operates the fuel valve. Similar to the aforenoted Barnaby U.S. Pat. No. 2,602,434, the Gates patent comprises spillports, and the housing incorporates means for selectively altering the movement (i.e., the travel distance) of the plunger relative to its cylindrical housing—thereby to regulate the fuel valve.

The Gates System is known to be most efficient. Too, the housing-incorporated plunger movement or travel adjustment therein is a thoughtful innovation. Yet, the housing structure and spillports thereof are somewhat complex—at least as to manufacture and maintenance. There has been a long-felt need for a simpler fuel valve controlling means, a means having a facile adjustment arrangement, and non-complex of manufacture and maintenance.

It is an object of this invention to set forth such a simpler fuel valve controlling means.

Particularly, it is an object of this invention to set forth a means for controlling a hydraulically-operated fuel valve, comprising a housing; said housing having a chamber-defining bore formed therein; means for admitting hydraulic fluid into said bore-defined chamber; means for expelling hydraulic fluid from said chamber, to operate a hydraulically-operated fuel valve; and means for receiving hydraulic fluid which has been expelled by said expelling means and conducting the same through said bore, for venting thereof from said housing; wherein said receiving and conducting means comprises a pair of spaced apart ports, each of said ports opening externally of said housing and internally onto said bore; said expelling means comprises valving means movable within said bore for opening and closing said ports to and from communication with each other for given periods of time; and said housing further has means selectively operative for altering movement of said valving means relative to said housing, correspondingly to alter said given periods of time.

Figure 2:
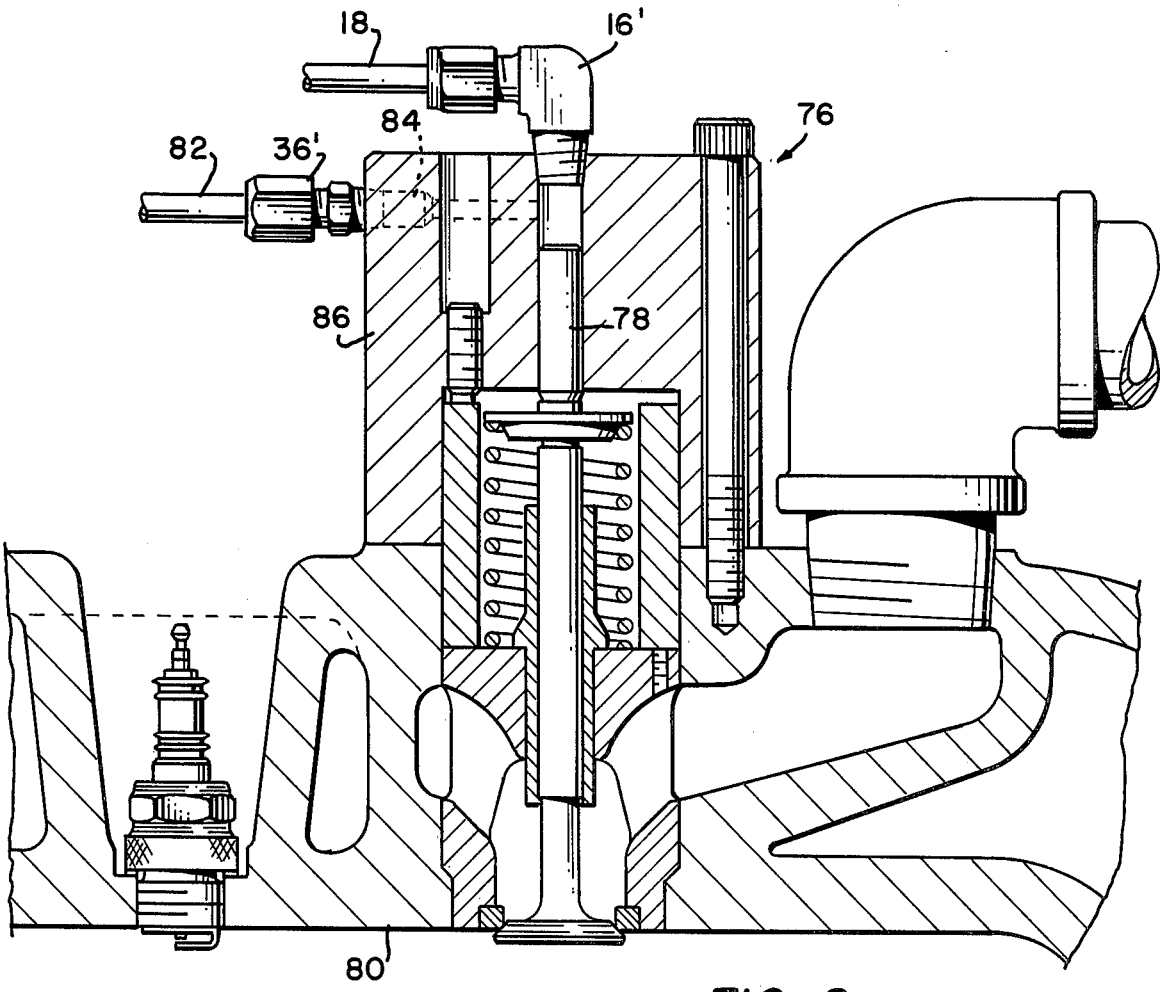

Further objects of this invention, as well as the novel features thereof, will become more apparent by reference to the following description taken in conjunction with the accompanying figures, in which:

FIG. 1 is a vertical, cross-sectional view of an exemplary embodiment of the invention; and FIG. 2 is a vertical, cross-sectional view of a prior art type of hydraulically-operated fuel valve controllable by the FIG. 1 embodiment of the invention.

As shown in FIG. 1, a fuel valve controlling means embodiment 10 comprises a housing 12 having a cylindrical bore 14 formed therein. The uppermost end of the bore is threaded and has an elbow 16 and conduit 18 coupled thereat. A pair of axially spaced-apart ports 20 and 22 are formed through the wall of the housing 12, and open onto the bore 14. Port 20 has a fitting 24 and hydraulic-fluid supply line 26 coupled thereto, whereas port 22 has a fitting 28 and a hydraulic-fluid return line 30 coupled thereto. Conduit 18, and lines 26 and 30, have check valves 31 therein to prevent fluid backflow.

Intermediate ports 20 and 22, and on the side of the housing opposite thereto, there is formed a further port 32 which also opens onto the bore 14. In alignment with port 32, the housing bore has an annular groove 34, the same defining a compartment subsisting between the outermost surface of a plunger 38 and the outermost surface of the groove 34. Port 32 also has a fitting 36 and a hydraulic line coupled thereto—for a purpose subsequently explained.

Bore 14 slidably receives the plunger 38 which, adjacent the upper end thereof, has an annular, relieved portion 39. The lower end of the plunger has a flat plate 40 integral therewith disposed for operative engagement with a rotating cam 42 on a camshaft 44.

Housing 12 comprises a couple of housing elements **12*a* and 12*b*. The first of these, housing element 12*a*, has the afore-mentioned ports, bore, and groove, whereas the second, housing element 12*b*, serves as a piloting means for the first. Element 12*b* has a central aperture 46 which slidably receives a central, depending pilot-limb 48 of element 12*a*. Also, element 12*b* has an annular shoulder 50 therewithin which receives one end of a compression spring 52; the other end of spring 52 engages the flat plate 40 of the plunger 38**.

In facing surfaces 54 and 56, respectively, of housing elements **12*a* and 12*b*, are a plurality of corresponding, aligned, shallow recesses 58 and 58***a*. While only two pairs of such recesses appear in this cross-section, this embodiment 10 comprises six pair—equally-spaced apart about the surfaces 54 and 56. Six compression springs 60 (only two being shown) are interposed between surfaces 54 and 56, in the recesses 58 and 58*a*, to urge the elements 12*a* and 12*b* apart. Two pairs of the recesses 58 and 58*a*, i.e., pairs on opposite sides of the housing elements 12*a* and 12*b*, have aligned pin holes 62 and 62*a* formed therein which receive pilot pins 64 (only one of such being shown).

An outer surface 66 of housing element 12*b* is threaded and receives an adjusting coupling nut 68. Nut 68 has an annular, inwardly-directed collar 70 which engages an annular, outwardly-directed shoulder 72 formed on housing element 12*a*. Accordingly, through the cooperation of springs 60, nut 68 can be turned to bring housing elements 12*a* and 12*b* into and out of greater proximity to and with each other.

Cam 42, in cooperation with spring 52, and in a manner well known in the prior art, will cause the plunger 38 to translate through the bore 14. Spring 52 urges the plunger 38 downwardly, and the cam 42 cyclically lifts the plunger 38 upwardly. During its upward travel, plunger 38 expels a prescribed charge of hydraulic fluid from the bore 14—specifically from the uppermost portion thereof which defines a hydraulic-fluid chamber 74, through conduit 18. Too, as the plunger 38 rises in bore 14, it brings the annular, relieved portion 39 thereof into communication with both the annular groove 34, in housing element 12*a*, and port 22. As a consequence, then, annular, relieved portion 39 cyclically effects fluid-flow communication between port 32 (with its companion groove 34) and port 22.

It is just such a fuel valve 76 as is shown in FIG. 2, the same being similar to prior art types thereof, which is operated and regulated by the controlling means embodiment 10. Conduit 18 supplies its plunger-expelled, valve-operating charge of hydraulic fluid to the valve-actuating plunger 78 of valve 76—to cause the latter to open and admit fuel into the cylinder 80. In order to vent the hydraulic fluid charge from the fuel valve 76, and allow the valve to close, a line 82 is interconnected between a vent port 84 formed in the valve housing 86, and the fitting 36 in port 32 of housing element 12*a* (FIG. 1).

Of course, for as long as the operating charge of fluid is addressed to the plunger 78 of valve 76, the valve will remain open to the admittance of fuel. Now, the subsequent communication of port 32 and groove 34 with port 22, through the upward translation of plunger 38, provides a vent path for the valve-operating fluid. The period of time during which the valve 76 will be held open, depends upon how soon, or how late, the plunger relieved portion 39 reaches the groove 34. If the adjusting, coupling nut 68 is turned down towards housing element 12*b*, the two housing elements will be brought into closer proximity, the plunger relieved portion 39 will reach groove 34 early, and the valve 76, correspondingly, will close early. Alternatively, if the adjusting, coupling nut 68 is turned up away from housing element 12*b*, the opposite functions will result; the relieved portion 39 will reach groove 34 late, and valve 76 will close late—correspondingly. In the first set of circumstances, the plunger 38 travels a given distance through the housing portion 12*a*, and in the second set of circumstances, the plunger 38 travels a lesser distance therethrough.

Line 82, cooperating with the interaction of plunger relieved portion 39, groove 34, and ports 84, 32, and 22, vents the valve-operating hydraulic fluid through the housing element 12*a* to return line 30; the latter discharges the fluid to a reservoir (not shown).

By simple, turning adjustment of coupling nut 68, then, the operation of the cylinder 80 (i.e., the stroke of the valve 76) may be finely tuned. Each cylinder of an engine, then, will have such a controlling means embodiment 10 regulatingly coupled thereto, and all such cylinders can be individually adjusted to properly balance the engine loading.

My novel controlling means is simple of construction and maintenance, having no complicated bores and passages to be formed therein, and requiring a minimum of component parts.

While I have described my invention in connection with a specific embodiment thereof, it is to be clearly understood that this is done only by way of example, and not as a limitation to the scope of my invention as set forth in the objects thereof and in the appended claims.

I claim:

1. Means for controlling a hydraulically-operated fuel valve, comprising:

a housing;

said housing having a chamber-defining bore formed therein;

means for admitting hydraulic fluid into said bore-defined chamber;

means for expelling hydraulic fluid from said chamber, to operate a hydraulically-operated fuel valve; and means for receiving hydraulic fluid which has been expelled by said expelling means and conducting the same through said bore, for venting thereof from said housing; wherein said receiving and conducting means comprises a pair of spaced apart ports, each of said ports opening externally of said housing and internally onto said bore;

said expelling means comprises valving means movable within said bore for opening and closing said ports to and from communication with each other for given periods of time; and said housing further has means selectively operative for altering movement of said valving means relative to said housing, correspondingly to alter said given periods of time.

2. Controlling means, according to claim 1, wherein:

said expelling means further comprises first conduit means opening at one end thereof onto said chamber, and having an opposite end which is remote from said chamber;

said receiving and conducting means further comprises second conduit means opening at one end thereof onto one port of said pair, and having an opposite end for effecting a fluid-flow communication with said remote, opposite end of said first conduit means.

3. Controlling means, according to claim 1, wherein:

said housing comprises first and second, distinct housing elements; and said selectively operative means, for altering said valving means movement, comprises adjustment means for effecting relative displacements between said first and second elements.

4. Controlling means, according to claim 3, wherein:

said adjustment means comprises one means intercoupling said first and second housing elements and operative to move at least one of said elements in first and second opposite directions into and out of proximity with the other of said elements, and another means interposed between said first and second housing elements for urging said one housing element in one of said first and second opposite directions.

5. Controlling means, according to claim 3, wherein: said first and second housing elements are slidably engaged with each other, one of said elements having an aperture formed therein, and the other of said elements having a pilot-limb portion in slidable penetration of said aperture.

6. Controlling means, according to claim 1, wherein: said housing further has a compartment therewithin, said compartment being defined by a surface of said plunger and a surface of said housing; and a first of said ports of said pair is in fluid-flow communication with said compartment.

7. Controlling means, according to claim 6, wherein: said compartment-communicating first port is said one port.

8. Controlling means, according to claim 8, wherein: said relieved surface cyclically opens into communication with said compartment and maintains a constant communication with said other port, during cyclic translations of said plunger.

* * * * *